US006439756B1

(12) United States Patent
Forschner et al.

(10) Patent No.: US 6,439,756 B1
(45) Date of Patent: Aug. 27, 2002

(54) AGITATOR

(75) Inventors: Peter Forschner, Hasel; Günther Greiner, Rickenbach-Egg; Werner Himmelsbach, Rheinfelden, all of (DE)

(73) Assignee: EKATO Rühr- und Mischtechnik GmbH, Schopfheim (DE)

( * ) Notice: Subject to any disclaimer, the term of this patent is extended or adjusted under 35 U.S.C. 154(b) by 0 days.

(21) Appl. No.: 09/561,722

(22) Filed: May 1, 2000

(30) Foreign Application Priority Data

May 27, 1999 (DE) ..... 299 09 312 U

(51) Int. Cl.[7] ..... B01F 3/04
(52) U.S. Cl. ..... 366/102; 261/87; 416/90 R
(58) Field of Search ..... 366/101, 102, 366/103, 107, 104, 106; 261/84, 85, 87, 90; 416/90 R; 239/259, 251

(56) References Cited

U.S. PATENT DOCUMENTS 190,185 A * 5/1877 Brandenburg
1,065,985 A * 7/1913 Swem
1,383,881 A * 7/1921 Thomas
1,417,883 A * 5/1922 Beers
2,413,925 A * 1/1947 Massion
2,592,904 A * 4/1952 Jackson
2,652,228 A * 9/1953 Merrick
2,928,661 A * 3/1960 Maclaren
3,066,921 A * 12/1962 Thommel et al.
3,482,520 A * 12/1969 Larsen
4,066,722 A * 1/1978 Pietruszewski et al.
4,231,974 A * 11/1980 Engelbrecht et al.
4,371,480 A * 2/1983 Vos
4,838,703 A * 6/1989 McMaster et al.
5,620,250 A * 4/1997 Chilcoat et al.
5,660,766 A * 8/1997 Van Dyk
6,183,706 B1 * 2/2001 King

* cited by examiner

*Primary Examiner*—Tony G. Soohoo
(74) *Attorney, Agent, or Firm*—Henry M. Feiereisen

(57) ABSTRACT

An agitator for agitating liquids in an agitator vessel for suspending solids and dispersing gas in a liquid, in particular in an absorber of a flue gas desulfurizing plant, includes an agitator vessel, an agitator shaft extending into the agitator vessel, and an agitating propeller mounted to the agitator shaft within the agitator vessel. The agitator shaft is hollow to define an interior space for conducting gas into the agitator vessel and injecting gas on the pressure side of the agitating propeller into the liquid.

57 Claims, 5 Drawing Sheets

AGITATOR

CROSS-REFERENCES TO RELATED APPLICATIONS

This application claims the priority of German Patent Application Serial No. 299 09 312.3, filed May 27, 1999, the subject matter of which is incorporated herein by reference.

BACKGROUND OF THE INVENTION

The present invention relates to an agitator for agitating liquids in an agitator vessel, with a gas being added to the liquid, in particular for suspending solids and dispersing gas in the liquid in flue gas desulfurizing plants.

Gas injection pipes or gas injection lances have been used to date for gassing of absorbers of flue gas desulfurizing plants and formed as simple, horizontal pipes with bores or vertical pipes through which gas, normally air, is injected. These pipes or lances are, however, incapable to efficiently distribute high gas rates.

SUMMARY OF THE INVENTION

It is thus an object of the present invention to provide an improved agitator, obviating the afore-stated drawbacks.

In particular, it is an object of the present invention to provide an improved agitator by which higher gas rates can be efficiently distributed in the liquid in the agitator vessel, and the injected gas can be pre-dispersed by the agitator.

These objects, and others which will become apparent hereinafter, are attained in accordance with one embodiment of the present invention by providing an agitator vessel; an agitator shaft extending into the agitator vessel, with the agitator shaft being hollow to define an interior space for conducting gas into the agitator vessel; and an agitating propeller mounted to the agitator shaft within the agitator vessel.

According to another embodiment, the agitator is provided with a hollow hub which is connected in fixed rotative engagement with the agitator shaft and through which gas is conducted for introduction into the agitator vessel.

According to still another embodiment, the agitator shaft is provided with a plurality of pipes which are securely fixed to the agitator shaft and to which gas is directly supplied from outside the agitator vessel.

Suitably, the hollow agitator shaft and the hollow hub are provided in the area of their vessel-proximal ends with transverse bores for introduction of gases into the agitator vessel.

Advantageously, a gas injection device is arranged in the area of the vessel-proximal end of the agitator shaft or the hub.

The gas injection device may be configured in the form of a plurality of pipes which extend, in particular radial, to the longitudinal axis of the agitator shaft or hub, and are in communication with the interior space of the agitator shaft or hub or the pipes connected to the agitator shaft.

According to another variation, the gas injection device is configured in the form of a chamber which surrounds the agitator shaft or the hub and is in communication with the interior space of the agitator shaft or the hub.

Preferably, the gas injection device in the form of the pipes or the chamber has outlet openings through which the gas flows into the agitator vessel and which are located on a diameter which is approximately 35 to 75% of the diameter of the agitating propeller. It is further advantageous to configure the outlet openings of the pipes and the chamber on the backside as relating to the rotation direction of the gas injection device, i.e. on the underpressure side of the pipes or the chamber. The outlet openings of the gas injection device for introducing gas into the agitator vessel are arranged, preferably, on the pressure side of the agitating propeller.

In order to prevent a recoil of gas back to the agitating propeller, the axial distance of the gas injection device to the agitating propeller is suitable approximately 25% to 75% of a diameter of the propeller.

According to another feature of the present invention, a stationary distributor head can be provided for the supply of gas.

Advantageously, the hub is configured only in the area of the inner end of the solid agitator shaft, with the gas being directly supplied to the hollow hub via a pipe which traverses the wall of the agitator vessel.

BRIEF DESCRIPTION OF THE DRAWING

The above and other objects, features and advantages of the present invention will be more readily apparent upon reading the following description of a preferred exemplified embodiment of the invention with reference to the accompanying drawing, in which.

DETAILED DESCRIPTION OF PREFERRED EMBODIMENTS

Figure 1:
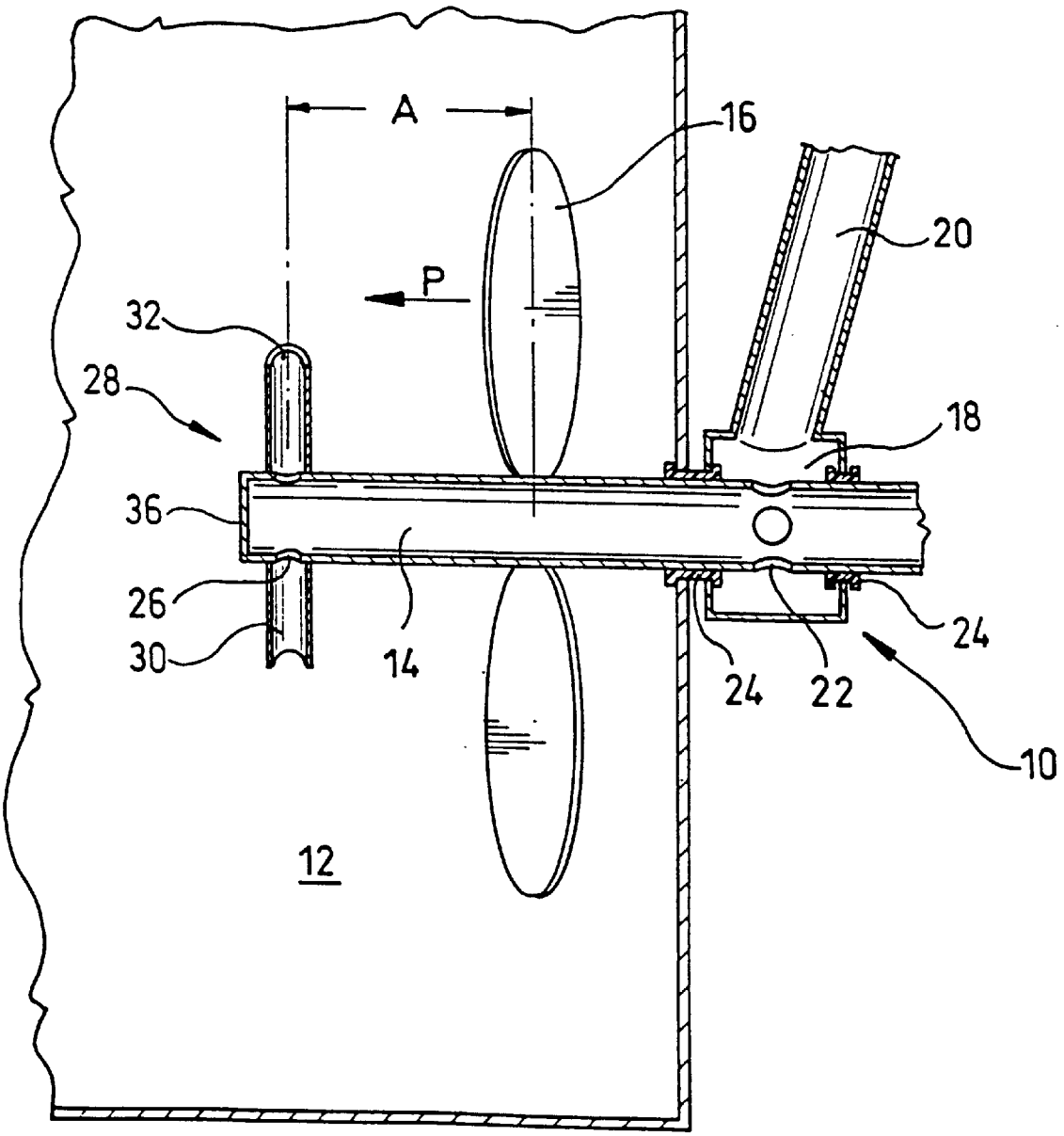
FIG. 1 is a schematic, partially sectional view of a first embodiment of an agitator according to the invention.

Throughout all the Figures, same or corresponding elements are generally indicated by same reference numerals.

Turning now to the drawing, and in particular to FIG. 1, there is shown a schematic, partially sectional view of a first embodiment of an agitator according to the invention, generally designated by reference numeral 10 and mounted in the interior of an agitator vessel 12, e.g. an absorber of a flue gas desulfurizing plant, containing a liquid. Heretofore, such absorbers use horizontal gassing pipes or gassing lances which are, however, incapable to efficiently distribute gas at high gas rates. It is therefore suitable to utilize an agitator to carry out a pre-dispersion of the gas that is injected in the liquid of the absorber.

The agitator 10 includes an agitator shaft 14 which can be rotated by an external drive (not shown) and projects from outside through the wall of the agitator vessel 12 into the interior of the agitator vessel 12. The agitator shaft 14 is defined by a longitudinal axis which extends in assembled state of the agitator 10 in a substantially horizontal orientation. Although not shown in drawing, the longitudinal axis of the agitator shaft 14 may also extend at a downward inclination of about 15°.

An axial conveyor in the form of an agitating propeller 16 is mounted to the agitator shaft 14 in the interior of the agitator vessel 12 and connected in fixed rotative engagement with the agitator shaft 14 for conveying the contents being agitated in a direction of arrow P.

As shown in FIG. 1, the agitator shaft 14 is hollow and coupled outside the agitator vessel 12 with a stationary distributor head 18 to which gas, for example air, from a gas source is supplied via a feed pipe 20 and by means of a fan (not shown). The agitator shaft 14 has radial bores 22 in the area of the distributor head 18 for introduction of gas from the distributor head 18 into the interior of the agitator shaft 14. Appropriate seals 24, for example lip seals, labyrinth seals or gap seals, are incorporated between the stationary distributor head 18 and the rotatable agitator shaft 14 as well as between the agitator shaft 14 and the wall of the agitator vessel 12 to prevent escape of gas.

The agitator shaft 14 has a closed inner end 36 and is provided in the area of the inner end 36 with through-openings 26 which are formed in the cylinder wall of the agitator shaft 14 and extend transversely to its longitudinal axis. Mounted in fixed rotative engagement in proximity of the inner end 36 of the agitator shaft 14 is a gas injection device, generally designated by reference numeral 28, for introduction of gas, supplied via the hollow agitator shaft 14, into the liquid in the agitator vessel 12. As the gas injection device 28 is connected in fixed rotative engagement with the agitator shaft 14, a structural unit, comprised of the agitator shaft 14, the propeller 16 and the gas injection device 28, is realized, which rotates as a unit. The gas injection device 28 may be designed in various ways, two of which will be described in more detail furtherbelow with reference to FIGS. 4 and 5.

As further shown in FIG. 1, the agitating propeller 16 has a center plane which is spaced from the center plane of the gas injection device 28 by an axial distance A which ranges suitably about 25 to 75% of a diameter of the propeller 16 so that a possible recoil of gas cannot impair the action of the axial conveyor, i.e. of the propeller 16.

Figure 2:
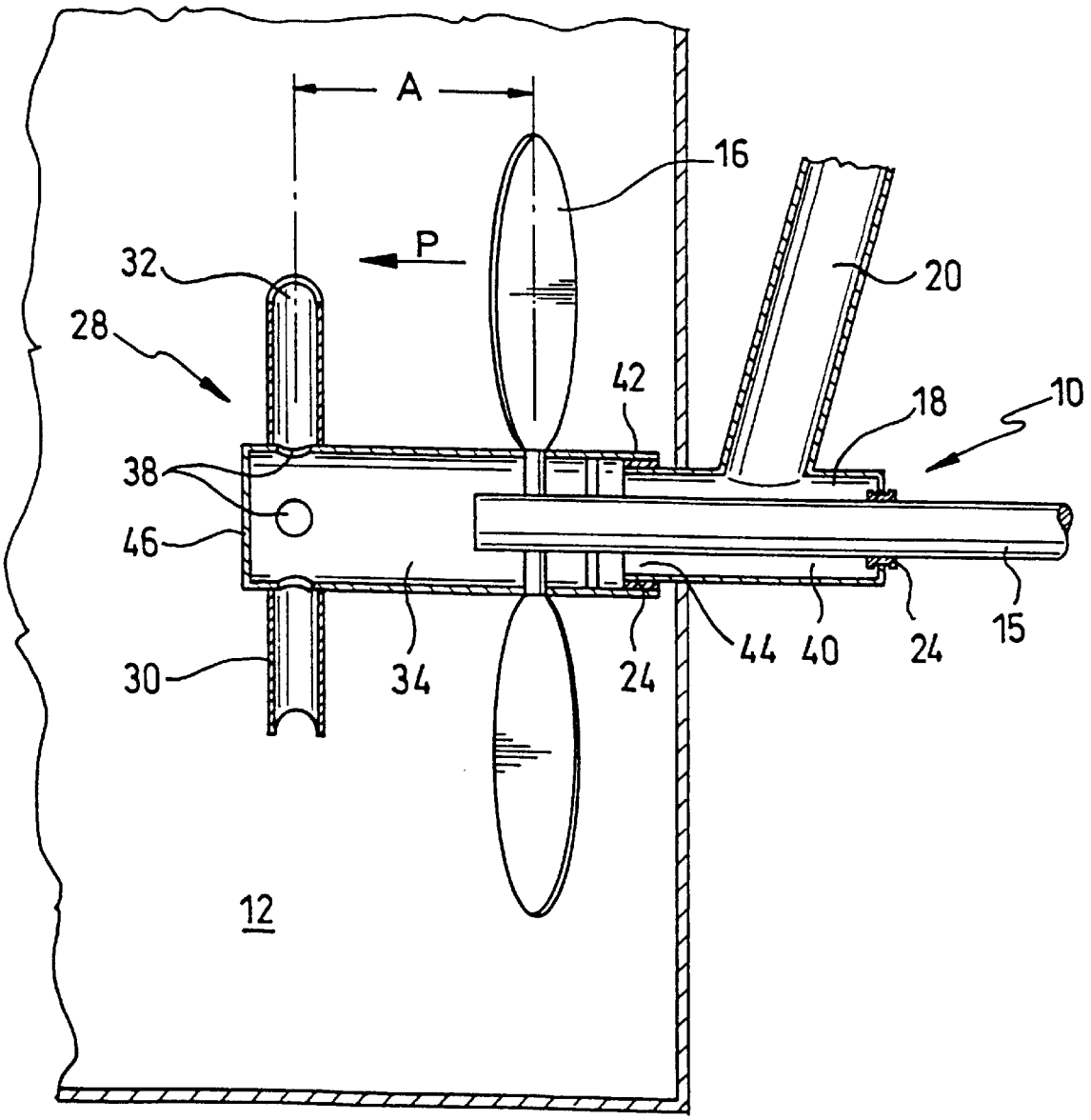
FIG. 2 is a schematic, partially sectional view of a second embodiment of an agitator according to the invention.

Turning now to FIG. 2, there is shown a further embodiment of an agitator 10 according to the present invention. Parts corresponding with those in FIG. 1 are generally denoted by identical reference numerals and not explained again. In this embodiment, provision is made for a solid agitator shaft 15 and a hollow hub 34, which is in fixed rotative engagement with the agitator shaft 15 and the propeller 16, for conducting gas supplied from the feed pipe 20 and via a ring space 40 demarcated between the agitator shaft 15 and the stationary distributor head 18 arranged outside the agitator vessel 12. The distributor head 18 is coupled with the agitator shaft 15 which is guided through the distributor head 18. Seals 24 are incorporated between the distributor head 18 and the agitator shaft 15 to prevent escape of gas. Mounted to the inner end of the agitator shaft 15 is the axial conveyor in the form of the agitating propeller 16 which extends radially in to the interior of the vessel 12 via suitable bores in the hub 34 and conveys liquid in the vessel 12 in the direction of the arrow P.

The hub 34 extends in surrounding concentric relationship to the agitator shaft 15 and has an inner end 46 and an outer end 42 which is in overlapping disposition with an inner end 44 of the distributor head 18. In the embodiment of FIG. 2, the distributor head 18 projects slightly through the wall of the agitator vessel 12 into the interior of the agitator vessel 12. A suitable seal 24 is incorporated between the outer end 42 of the hub 34 and the inner end 44 of the distributor head 18. The inner end 46 of the hub 34 is closed, and the hollow hub 34 is provided in the area of the inner end 46 with radial bores 38 formed in the cylindrical wall of the hub 34. Mounted in fixed rotative engagement to the inner end 46 of the hub 34 and in alignment with the bores 38 is the gas injection device 28 in a configuration, as will be described with reference to FIGS. 4 and 5. Thus, the gas injection device 28 forms with the hub 34 and the propeller 16 again a structural unit which rotates as a unit. Gas supplied through the hollow hub 34 enters via the radial bores 38 into the gas injection device 28, and the gas is injected into the liquid in the agitator vessel 12 through the outlet openings 32 of the gas injection device 28.

Figure 4:
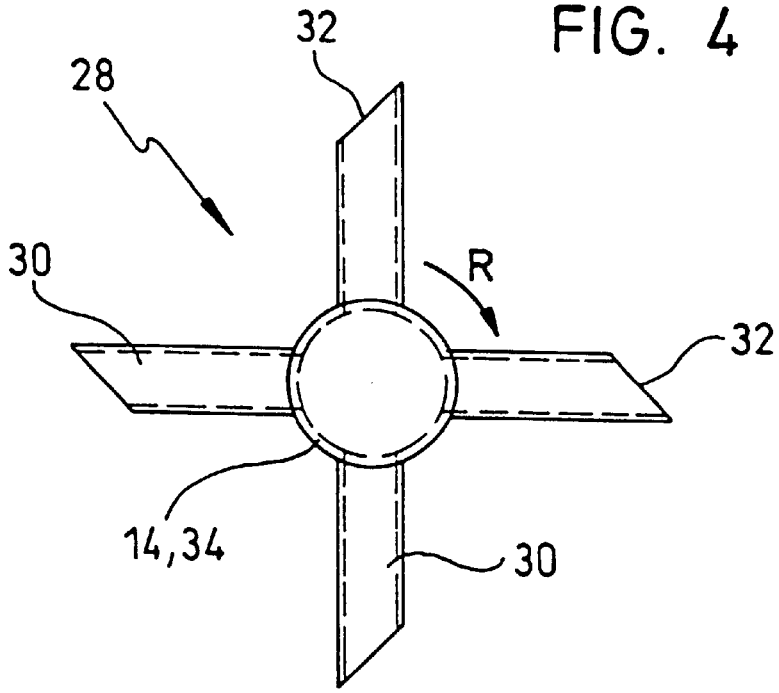
FIG. 4 is a schematic end view of a gas injection device for introduction of gas into a vessel of the agitator.

As shown schematically in FIG. 4, the gas injection device 28 may include four radial pipes 30 extending out from the agitator shaft 14 or the hub 34. Persons skilled in the prior art will understand that although FIG. 4 shows the provision of four pipes 30, it is certainly within the scope of the present invention to provide more or less than four pipes 30. In the illustrated example of FIG. 4, the pipes 30 have beveled free ends, for example at an angle of 45° with respect to their longitudinal axis, thereby forming beveled outlet openings 32 in fluid communication with the bores 26 or bores 38 of the agitator shaft 14 or the hub 34, respectively, for injection of gas. Although not shown in detail, it is certainly possible to close the outer free end of the pipes 30 and to provide in the cylinder wall of the pipes 30 one or more bores to form the outlet openings. The outlet openings 32 of the pipes 30 are suitably located on a diameter of a circle which is greater than the diameter of the agitator shaft 14 or the hub 34 whereby, preferably, the diameter of the circle, upon which the centers of the outlet openings 32 lie, is about 35% to 75% of the diameter of the propeller 16.

The outlet openings 32 of the pipes 30 are disposed, relative to the rotation direction R of the gas injection device 28, on the backside of the pipes 30, i.e. on the underpressure side of the gas channels in the pipes 30, so that an underpressure corresponding to the dynamic pressure in front of the pipes, is generated which reduces a possible pressure loss in the gas supply or which can be exploited for self-aspiration (without external fan) upon small liquid coverings of the outlet openings 32.

Figure 5:
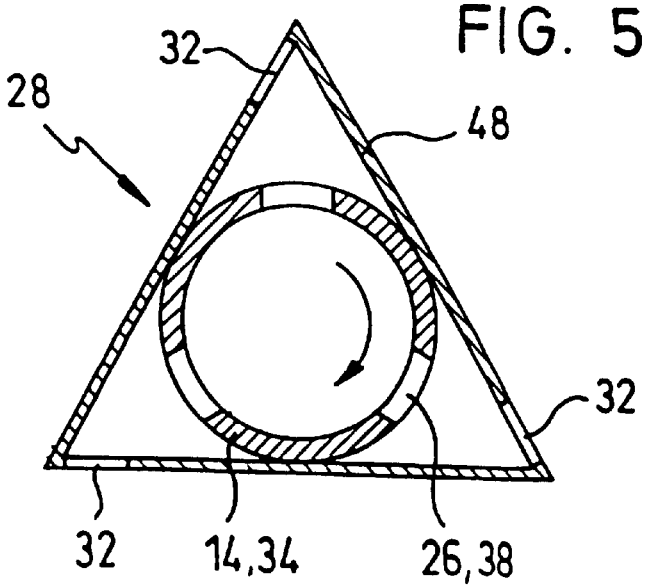
FIG. 5 is a schematic end view of a variation of the gas injection device.

Another example of the gas injection device 28 is shown in FIG. 5 and has the form of, for example, a triangular, chamber 48 which surrounds the vessel-proximal end of the hollow agitator shaft 14 according to the agitator 10 of FIG. 1 or the hollow hub 34 according to the agitator 10 of FIG. 2, and is connected in fixed rotative engagement with the agitator shaft 14 or the hub 34. The axial width of the chamber 48 in the direction of the longitudinal axis of the agitator shaft 14 ore the hub 34 is so selected that the chamber 48 covers at least the radial bores 26 of the agitator shaft 14 or the radial bores 38 of the hub 34. Suitably, the width of the chamber 48 is, however, greater than the diameter of these bores 22 or 38.

In the non-limiting example of FIG. 5, the chamber 48 has three outlet openings 32 through which gas, conducted through the agitator shaft 14 or the hub 34 and entering through the bores 26 of the agitator shaft 14 or bores 38 of the hub 34 into the chamber 48, is injected into the agitator vessel 12. The outlet openings 32 may extend over the entire axial width of the chamber 48 and are located with respect to the rotation direction R of the gas injection device 28 on the backside of the chamber 48 so as to generate the underpressure as already described above in conjunction with the embodiment of FIG. 4.

Like in the gas injection device according to FIG. 4, the axial distance A between the center plane of the propeller 16 and the axial center plane of the chamber 48 is about 25% to 75% of the diameter of the propeller 16. Also the centers of the outlet openings 32 of the chamber 48 are located on a diameter which is about 35% to 75% of the propeller diameter.

In the embodiment of the agitator 10 according to FIG. 1, gas is conducted from a fan (not shown) via the feed pipe 20, the distributor head 18, the radial bores 22, the hollow agitator shaft 14, and the radial bores 26 in the agitator shaft 14 into the gas injection device 28 (either through pipes 30 of FIG. 4 or through the chamber 48 of FIG. 5) and is injected through the outlet openings 32 into the liquid in the agitator vessel 12.

In the embodiment of the agitator 10 of FIG. 2, gas is introduced by means of a fan (not shown) via the feed pipe 20, the ring space 40 between the agitator shaft 15 and the distributor head 18, the hollow hub 34 and the radial bores 38 of the hub 34 into the gas injection device 28 (either pipes 30 of FIG. 4 or the chamber 48 of FIG. 5) is injected through its outlet openings 32 into the liquid in the agitator vessel 12.

The gas injection device 28, having a radial distance A from the propeller 16, is positioned with respect to the peripheral wall of the agitator vessel 12 inwards from the propeller 16 on the pressure side of the latter. Thus, gas is introduced from outside through the hollow agitator shaft 14 in the embodiment of the agitator of FIG. 1, or through the hollow hub 34 in the embodiment of the agitator of FIG. 2, into the agitator vessel 12 and supplied by means of the gas injection device 28 on the pressure side of the propeller 16 to the liquid contained in the agitator vessel 12.

The propeller 16 generates a sufficiently strong liquid jet to suspend solids in the liquid and, at the same time, to disperse the gas in the liquid.

Figure 3:
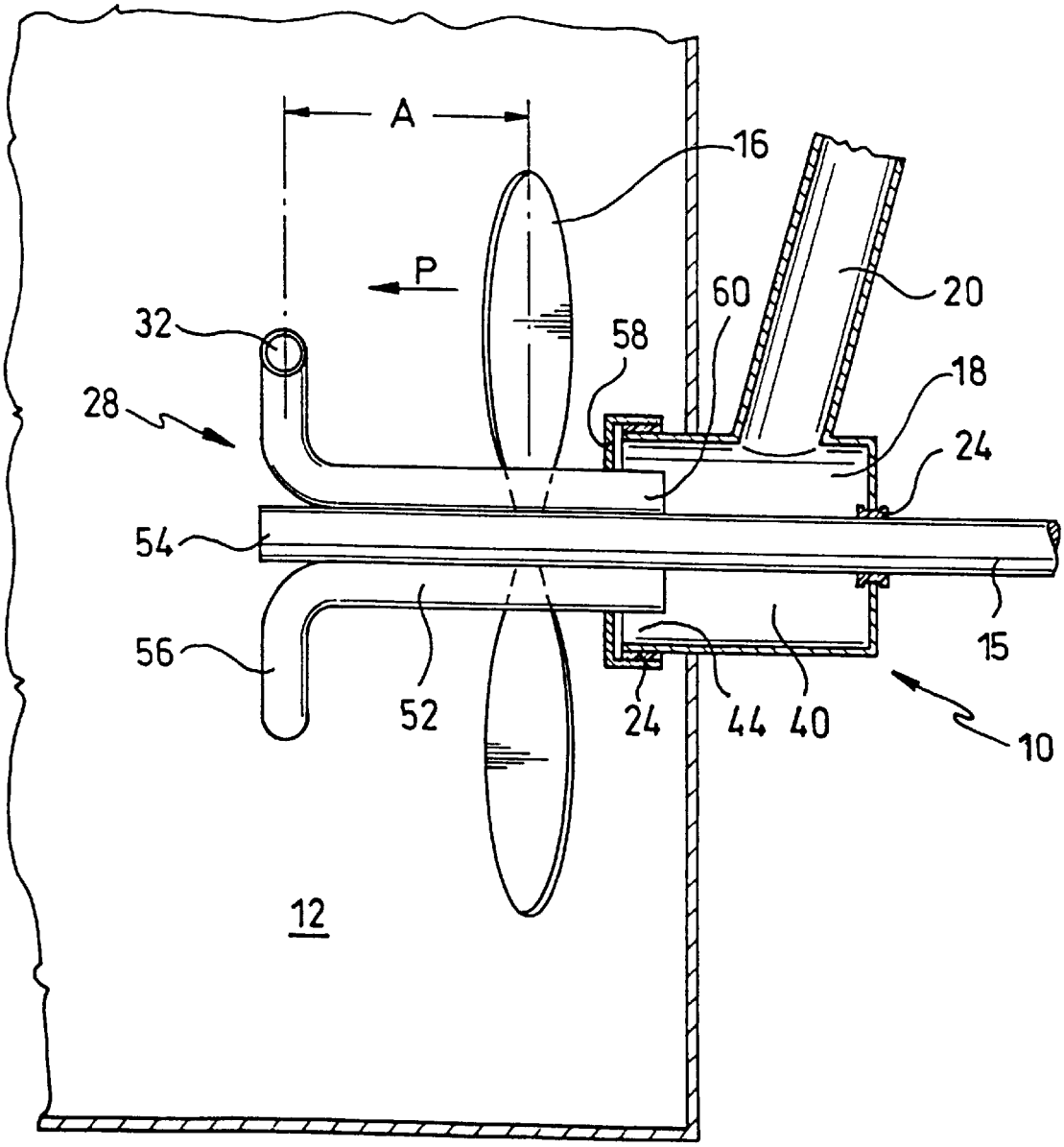
FIG. 3 is a schematic, partially sectional view of a third embodiment of an agitator according to the invention.

FIG. 3 shows schematically a side view of still another embodiment of an agitator 10 according to the present invention. Parts corresponding with those in FIG. 2 are denoted by identical reference numerals and not explained again. In the embodiment, provision is made again for a solid agitator shaft 15 and an axial conveyor in the form of the propeller 16 which is mounted in fixed rotative engagement to the agitator shaft 15. In a same manner as in the embodiment of FIG. 2, the inner end 44 of the stationary distributor head 18 projects slightly into the interior of the agitator vessel 12. The inner end 44 of the distributor head 18 is closed by an end wall 58 which is connected in fixed rotative engagement with the agitator shaft 15 and axially overlaps the inner end 44 of the distributor head 18. A suitable seal 24 is disposed between the end wall 58 and the inner end 44 of the distributor head 18 to prevent escape of gas. A further seal 24 is arranged between the distributor head 18 and the shaft 15.

Arranged on the outer circumference of the agitator shaft 15 are several, for example four, pipes 52 and securely fixed to the agitator shaft 15 in substantially parallel disposition to the agitator shaft 15. With their outer ends 60, the pipes 52 project through the wall 58 into the ring space 40 of the stationary distributor head 18. The pipes 52 are bent radially outwards, essentially at a right angle to the longitudinal axis of the pipes 52, in the area of the inner vessel-proximal end 54 of the agitator shaft 15 and thus form radial pipe sections 56 having free ends forming the outlet openings 32 for introduction of gas into the agitator vessel 12 and thus constituting the gas injection device 28.

The configuration of these outlet openings 32 and their disposition is the same as the outlet openings 32 of the pipes according to FIG. 1 or FIG. 2. Also the center plane of the pipe sections 56 has the axial distance A from the center plane of the agitating propeller 16.

Figure 6:
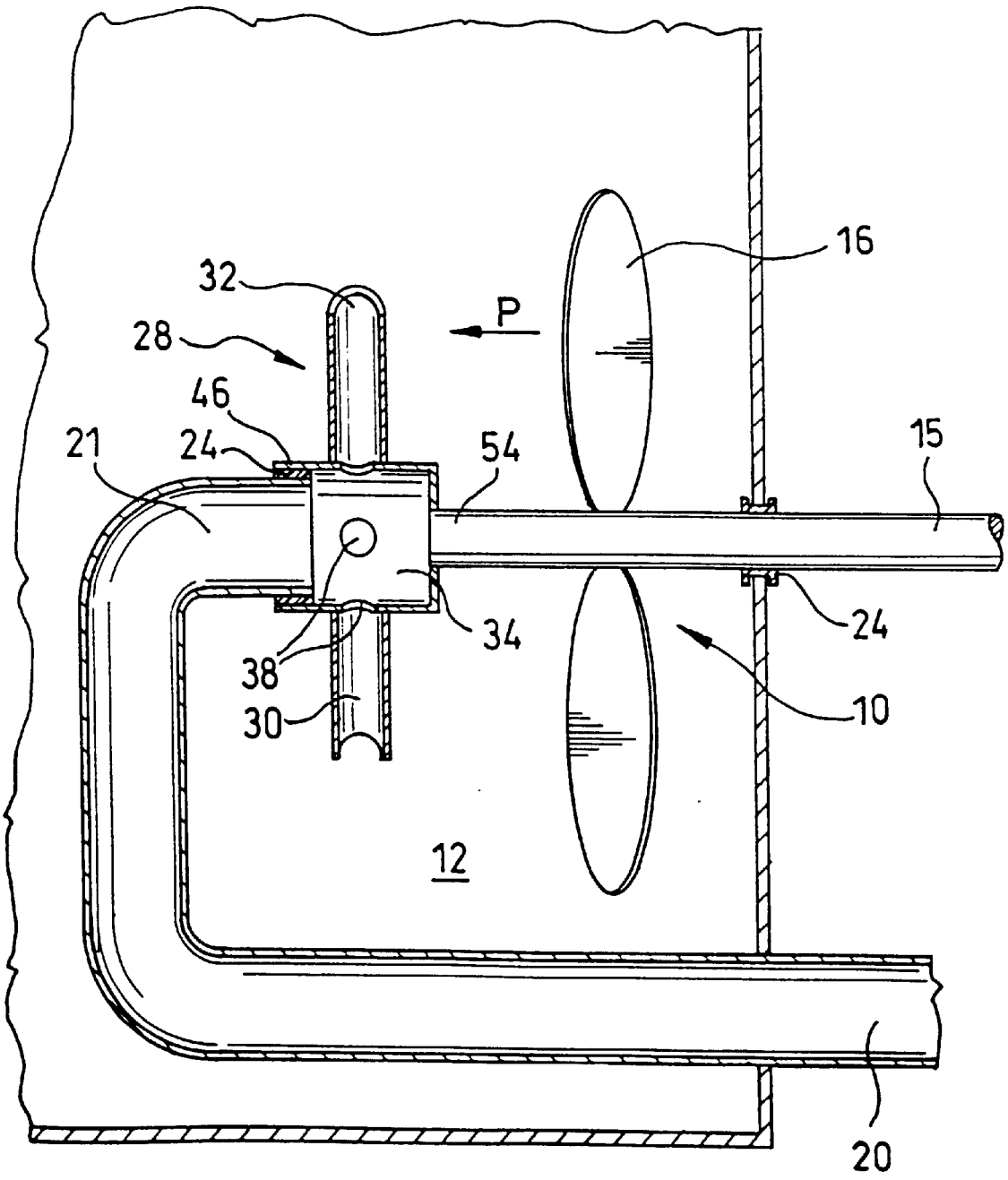
FIG. 6 is a schematic, partially sectional view of a fourth embodiment of an agitator according to the invention.

Turning now to FIG. 6, there is shown yet another embodiment of an agitator 10 according to the present invention. In this embodiment, the hub 34 is formed only in the area of the inner end 54 of the solid agitator shaft 15 and connected in suitable manner, for example through welding or by means of screws, with this inner end 54 of the agitator shaft 15. The vessel-proximal end 46 of the hollow hub 34 is open and the feed pipe 20 terminates in this end 46, with a suitable seal 24, for example a lip seal or a labyrinth seal or the like, being disposed between the rotating hub 34 and the stationary feed pipe 20. It is however also possible to provide a seal by means of a defined gap, thereby omitting the need for a particular seal.

Unlike the above-described embodiments, the pipe 20 is guided in the embodiment of FIG. 6 from outside through the wall of the agitator vessel 12. The pipe 20 suitably extends radially into the agitator vessel 12 and is then so curved that its end section 21 is again directed to the outside toward the wall of the agitator vessel for connection from inside into the hollow hub 34. In this manner, gas is introduced and injected via the feed pipe 20, 21 directly into the hollow hub 34.

The hub 34 according to FIG. 6 is provided with the already described gas injection device 28 which in turn includes the pipes 30 according to the variation of FIG. 4, or the chamber 48 according to the variation of FIG. 5.

The pipes 30, 52 and 56 may have a circular cross section, rectangular cross section or any other suitable cross section. The chamber 48 according to FIG. 5 may also have a rectangular cross section or any other suitable cross section.

Optionally, the gas injection device may be omitted altogether, and gas may be injected directly into the agitator vessel. Although this may be sufficient in some to attain a good dispersion of gas in conjunction with the flow generated by the propeller 16, the provision of the gas injection device 28 is preferred and realizes better results. The distributor head 18 may also be integrated in the wall of the agitator 10 or incorporated in its entirety in the interior of the agitator vessel 12. In this case, the feed pipe 20 is guided through the wall of the agitator vessel 12 and connected to the distributor head 18.

The agitator according to the invention realizes higher material transfer rates and higher gas throughputs than was possible to date with conventional gas injections devices.

While the invention has been illustrated and described as embodied in an agitator, it is not intended to be limited to the details shown since various modifications and structural changes may be made without departing in any way from the spirit of the present invention.

What is claimed as new and desired to be protected by Letters Patent is set forth in the appended claims:

What is claimed is:

1. An agitator for agitating liquids, with a gas being added to the liquid, in particular for suspending solids and dispersing gas in the liquid in flue gas desulfurizing plants, said agitator comprising:

an agitator shaft extending into an agitator vessel, said agitator shaft being hollow to define an interior space for conducting gas into the agitator vessel; and an agitating propeller mounted to the agitator shaft within the agitator vessel; and a gas injection device connected to the one end in fixed rotative engagement with the agitator shaft for introducing gas into the agitator vessel at an axial distance downstream of the agitating propeller in the conveying direction of the liquid.

2. The agitator of claim 1 wherein the hollow agitator shaft has one end disposed in the agitator vessel and formed with transverse bores for discharge of gas into the agitator vessel.

3. The agitator of claim 2 wherein the gas injection device includes a plurality of pipes extending out from the agitator shaft within the agitator vessel and fluidly connected with the interior space of the hollow agitator shaft.

4. The agitator of claim 3 wherein the pipes extend radially from the agitator shaft.

5. The agitator of claim 3 wherein the agitating propeller defines a diameter, each of said pipes terminating in an outlet opening, with the outlet openings of the pipes being located on a diameter which is about 35% to 75% of the diameter of the agitating propeller.

6. The agitator of claim 5 wherein the gas injection device rotates in a rotation direction, said outlet openings of the pipes being positioned on an underpressure side of the pipes with respect to the rotation direction of the gas injection device.

7. The agitator of claim 3 wherein the gas injection device includes a chamber which surrounds the agitator shaft and communicates with the interior space of the agitator shaft.

8. The agitator of claim 7 wherein the agitating propeller defines a diameter, said chamber having outlet openings which are located on a diameter which is about 35% to 75% of the diameter of the agitating propeller.

9. The agitator of claim 7 wherein the gas injection device rotates in a rotation direction, said outlet openings of the chamber being positioned on a underpressure side of the pipes with respect to the rotation direction of the gas injection device.

10. The agitator of claim 3 wherein the agitating propeller is defined by a center plane and has a diameter, said gas injection device being defined by a center plane which is spaced from the center plane of the agitating propeller by an axial distance which is about 25% to 75% of the diameter of the agitating propeller.

11. The agitator of claim 3 wherein the gas injection device is arranged on the pressure side of the agitating propeller for injecting gas into the agitator vessel.

12. The agitator of claim 1, and further comprising a stationary distributor head fluidly connected with the interior space of the agitator shaft for supply of gas.

13. The agitator of claim 12, wherein the agitator shaft has radial bores for fluidly connecting the interior space of the agitator shaft with the distributor head.

14. An agitator for agitating liquids, with a gas being added to the liquid, in particular for suspending solids and dispersing gas in the liquid in flue gas desulfurizing plants, said agitator comprising:

an agitator shaft extending into an agitator vessel;

a hub connected in fixed rotative engagement with the agitator shaft for conducting gas into the agitator vessel, said hub being hollow to define an interior space;

an agitating propeller mounted to the agitator shaft within the agitator vessel for axially moving a liquid in the agitator vessel in a conveying direction; and a gas injection device, connected in fixed rotative engagement to the hub to rotate conjointly with the hub, for injecting gas into the interior of the agitator vessel, wherein the gas injection device is disposed at an axial distance downstream of the agitating propeller in the conveying direction of the liquid.

15. The agitator of claim 14 wherein the agitator shaft has one end positioned in the agitator vessel, said hub being configured in the area of the one end of the agitator shaft, and further comprising a pipe guided from outside through a wall of the agitator vessel and connected to the hub for direct supply of gas to the hub.

16. The agitator of claim 14 wherein the hub is formed with transverse bores for introduction of gas into the agitator vessel.

17. The agitator of claim 14 wherein the gas injection device includes a plurality of pipes extending out from the hub within the agitator vessel and fluidly connected with the interior space of the hub.

18. The agitator of claim 17 wherein the pipes extend radially from the agitator shaft.

19. The agitator of claim 17 wherein the agitating propeller defines a diameter, each of said pipes terminating in an outlet opening, with the outlet openings of the pipes being located on a diameter which is about 35% to 75% of the diameter of the agitating propeller.

20. The agitator of claim 19 wherein the gas injection device rotates in a rotation direction, said outlet openings of the pipes being positioned on an underpressure side of the pipes with respect to the rotation direction of the gas injection device.

21. The agitator of claim 14 wherein the gas injection device includes a chamber which surrounds the hub and communicates with the interior space of the hub.

22. The agitator of claim 14 wherein the agitating propeller is defined by a center plane and has a diameter, said gas injection device being defined by a center plane which is spaced from the center plane of the agitating propeller by an axial distance which is about 25% to 75% of the diameter of the agitating propeller.

23. The agitator of claim 14 wherein the gas injection device is arranged on a pressure side of the agitating propeller.

24. The agitator of claim 14, and further comprising a stationary distributor head fluidly connected with the interior space of the hub for supply of gas.

25. The agitator of claim 24, wherein the agitator shaft and the distributor head define a ring space for fluidly connecting the interior space of the hub with the distributor head.

26. The agitator of claim 14, and further comprising a gas source in communication with the gas injection device for supplying gas to the gas injection device.

27. The agitator of claim 14 wherein the agitator shaft is solid.

28. An agitator for agitating liquids, with a gas being added to the liquid, in particular for suspending solids and dispersing gas in the liquid in flue gas desulfurizing plants, said agitator comprising:

an agitator shaft extending into an agitator vessel;

a plurality of pipes connected in a fixed rotative engagement to the agitation shaft and disposed about an outer circumference of and extending longitudinally in the direction of the agitator shaft for conduction of gas and introduction into the agitator vessel; and an agitating propeller mounted to the agitator shaft within the agitator vessel wherein the pipes end at an axial distance downstream of the agitating propeller in a conveying direction of the liquid.

29. The agitator of claim 28 wherein the agitator shaft is solid and has one end located in the agitator vessel, and further comprising a gas injection device connected in an area of the one end in fixed rotative engagement with the agitator shaft for introducing gas into the agitator vessel.

30. The agitator of claim 29 wherein the gas injection device includes a plurality of pipe sections which are fluidly connected to the pipes in one-to-one correspondence.

31. The agitator of claim 30 wherein the pipe sections and the pipes are formed in one piece with one another.

32. The agitator of claim 30 wherein the pipe sections extend in a radial direction.

33. The agitator of claim 30 wherein the agitating propeller defines a diameter, each of said pipe sections terminating in an outlet opening, with the outlet openings of the pipe sections being located on a diameter which is about 35% to 75% of the diameter of the agitating propeller.

34. The agitator of claim 33 wherein the gas injection device rotates in a rotation direction, said outlet openings of the pipe sections being positioned on a underpressure side of the pipe sections with respect to the rotation direction of the gas injection device.

35. The agitator of claim 29 wherein the agitating propeller is defined by a center plane and has a diameter, said gas injection device being defined by a center plane which is spaced from the center plane of the agitating propeller by an axial distance which is about 25% to 75% of the diameter of the agitating propeller.

36. The agitator of claim 29 wherein the gas injection device is arranged on the pressure side of the agitating propeller for injecting gas into the agitator vessel.

37. The agitator of claim 28, and further comprising a stationary distributor head fluidly connected to the pipes for supply of gas.

38. An agitator, comprising:

a gas-conducting receiving gas from a gas source and having an interior space terminating in an outlet means for introducing a gas into a vessel containing a liquid; and a propeller mounted to the gas-conducting device for stirring the liquid and dispersing the gas in the liquid wherein the outlet means is disposed at an axial distance downstream of the propeller in a conveying direction of the liquid.

39. The agitator of claim 38 wherein the gas-conducting device is a hollow shaft extending into the agitator vessel and defining an interior space for conducting the gas and discharge through the outlet means said propeller being mounted onto the shaft.

40. The agitator of claim 38 wherein the gas-conducting device includes a solid shaft extending into the vessel, and a hollow hub connected inside the vessel in fixed rotative engagement with the shaft and surrounding the shaft at a distance thereto to define an interior space for conducting the gas through the outlet means into the vessel, said propeller being mounted onto the shaft.

41. The agitator of claim 38 wherein the gas-conducting device includes a solid shaft extending into the vessel, and a plurality of pipes formed with the outlet means, said pipes fluidly communicating with the gas source and connected about an outer circumference of and extending longitudinally in the direction of the shaft for conduction of gas and introduction through the outlet means into the vessel, said propeller being mounted onto the shaft.

42. The agitator of claim 38 wherein the gas-conducting device includes a solid shaft extending into the vessel, a hollow hub mounted to the shaft inside the vessel and formed with the outlet means, and a pipe guided from outside through a wall of the vessel and connected to the hub for direct supply of gas to the hub.

43. The agitator of claim 38, and further comprising a gas injection device connected in fixed rotative engagement to the gas-conducting device in fluid communication with the outlet means.

44. The agitator of claim 43 wherein the gas injection device includes a plurality of pipes extending out from the gas-conducting device and fluidly connected with the interior space of the gas-conducting device.

45. The agitator of claim 44 wherein the pipes extend radially from the gas-conducting device.

46. The agitator of claim 43 wherein the gas injection device includes a chamber which surrounds the gas-conducting device and communicates with the interior space of the gas-conducting device.

47. The agitator of claim 46 wherein the propeller defines a diameter, said chamber having outlet openings which are in fluid communication with the outlet means of the gas-conducting device and located on a diameter which is about 35% to 75% of the diameter of the propeller.

48. The agitator of claim 47 wherein the gas injection device rotates in a rotation direction, said outlet openings of the chamber being positioned on an underpressure side of the pipes with respect to the rotation direction of the gas injection device.

49. The agitator of claim 43 wherein the propeller is defined by a center plane and has a diameter, said gas injection device being defined by a center plane which is spaced from the center plane of the propeller by an axial distance which is about 25% to 75% of the diameter of the propeller.

50. The agitator of claim 43 wherein the gas injection device is arranged on the pressure side of the propeller for injecting gas into the vessel.

51. The agitator of claim 38 wherein the propeller defines a diameter, said gas-conducting device including a plurality of outlet openings in fluid communication with the outlet means, said outlet openings being located on a diameter which is about 35% to 75% of the diameter of the propeller.

52. The agitator of claim 51 wherein the gas injection device rotates in a rotation direction, said outlet openings being positioned on an underpressure side of the gas-conducting device with respect to the rotation direction of the gas injection device.

53. The agitator of claim 38, and further comprising a stationary distributor head fluidly connected with the interior space of the gas-conducting device for supply of gas from the gas source.

54. An agitator for agitating liquids, with a gas being added to the liquid, in particular for suspending solids and dispersing gas in the liquid in flue gas desulfurizing plants, said agitator comprising:

an agitator vessel having an interior;

an agitator shaft extending into the interior of the agitator vessel to thereby define an axis;

an agitating propeller mounted to the agitator shaft within the agitator vessel for axially moving a liquid in the agitator vessel in a conveying direction; and a gas injection device, rotating conjointly with the agitator shaft and positioned at an axial distance downstream of the agitating propeller in the conveying direction of the liquid, for injecting gas into the interior of the agitator vessel.

55. The agitator of claim 54, wherein the gas injection device rotates in a rotation direction and has outlet openings positioned on an underpressure side with respect to the rotation direction of the gas injection device for gas so as to realize a pre-dispersing of the gas in concert with the propeller.

56. The agitator of claim 54, wherein the gas injection device is arranged on the pressure side of the agitating propeller for injecting gas into the agitator vessel.

57. The agitator of claim 54, and further comprising a gas source in communication with the gas injection device for supplying gas to the gas injection device.

* * * * *